US011872501B2

(12) United States Patent
Lorentz

(10) Patent No.: US 11,872,501 B2
(45) Date of Patent: Jan. 16, 2024

(54) INDICATING MEANS TO IDENTIFY POINTS OF IMPACT ON A TARGET

(71) Applicant: Claudiu Lorentz, San Bernardino, CA (US)

(72) Inventor: Claudiu Lorentz, San Bernardino, CA (US)

( * ) Notice: Subject to any disclaimer, the term of this patent is extended or adjusted under 35 U.S.C. 154(b) by 862 days.

(21) Appl. No.: 16/923,052

(22) Filed: Jul. 7, 2020

(65) Prior Publication Data

US 2021/0093946 A1 Apr. 1, 2021

Related U.S. Application Data

(60) Provisional application No. 62/844,629, filed on May 7, 2019.

(51) Int. Cl.

| | |
|---|---|
| ***A63F 9/02*** | (2006.01) |
| ***A41D 13/00*** | (2006.01) |
| ***A41D 27/08*** | (2006.01) |
| ***A41D 1/04*** | (2006.01) |
| ***A41D 31/02*** | (2019.01) |

(52) U.S. Cl.

CPC ..... *A63F 9/0243* (2013.01); *A41D 1/04* (2013.01); *A41D 13/0015* (2013.01); *A41D 27/08* (2013.01); *A41D 31/02* (2013.01); *A41D 2600/10* (2013.01); *A63F 2250/166* (2013.01)

(58) Field of Classification Search

CPC ... A63F 9/0243; A63F 2250/166; A41D 1/04; A41D 13/0015; A41D 27/08; A41D 31/02; A41D 2600/10; A63B 63/003; A63B 71/0608; F41J 5/20

See application file for complete search history.

(56) References Cited

U.S. PATENT DOCUMENTS

| | | | | |
|---|---|---|---|---|
| 4,952,436 | A * | 8/1990 | Ruschmann | D06Q 1/00 428/66.5 |
| 6,062,997 | A | 5/2000 | Seymour | |
| 7,012,187 | B2 | 3/2006 | Aldridge | |
| 7,604,556 | B2 | 10/2009 | Witzigreuter | |
| 10,174,450 | B2 * | 1/2019 | Akkad | D04D 7/04 |
| 2006/0157937 | A1 * | 7/2006 | Belog | F41H 1/02 273/348.4 |
| 2012/0045605 | A1 * | 2/2012 | Collins | B32B 5/26 428/221 |

(Continued)

FOREIGN PATENT DOCUMENTS

| | | | |
|---|---|---|---|
| CA | 2097225 | A1 | 11/1993 |

*Primary Examiner* — Michael D Dennis
(74) *Attorney, Agent, or Firm* — Kenneth Avila

(57) ABSTRACT

Disclosed is an indicating means that may be worn by a player or attached to a target when playing with non lethal projectiles to indicate when a player or a target has been struck by a projectile. The disclosed indicating means comprises a fabric containing sequins followed by a layer of padding beneath the fabric. Sequins are brushed into a first position at the start of game play. During game play, impact of a projectile onto the indicating means will be absorbed by the padding creating undulations radiating outwards from the point of impact causing the sequins to flip to a second position indicating that the player or target has been struck. The disclosed indicating means will work with any projectile, does not require an electrical charge to operate, is low cost, reusable, and durable.

8 Claims, 9 Drawing Sheets

(56) References Cited

U.S. PATENT DOCUMENTS

| | | | | |
|---|---|---|---|---|
| 2012/0279311 | A1 | 11/2012 | Helmer et al. | |
| 2015/0052664 | A1* | 2/2015 | Friedberg | A41D 27/08 2/244 |
| 2018/0195235 | A1* | 7/2018 | Luedecke | A43B 23/0255 |
| 2018/0199637 | A1* | 7/2018 | Quaglia | A63B 69/12 |
| 2018/0369704 | A1* | 12/2018 | Whitaker | A63H 3/36 |

* cited by examiner

INDICATING MEANS TO IDENTIFY POINTS OF IMPACT ON A TARGET

CROSS-REFERENCE TO RELATED APPLICATIONS

This application claims priority from U.S. Provisional Patent Application No. 62/844,629 filed on May 7, 2019. The entire disclosure of the prior application is considered to be part of the disclosure of the accompanying application and is hereby incorporated by reference.

BACKGROUND OF THE INVENTION

1. Field of the Invention

This invention relates generally to targets that may be used with toy projectiles. More particularly, the present invention relates to a fabric covered with reversible devices that can switch between two positions to indicate if the fabric has been struck by a toy projectile.

2. Description of the Related Art

Shooting types of games are very popular with young children. Playing cowboys and indians or cops and robbers are fun games that children can play to occupy their time. Children also enjoy target practice type of games where they shoot harmless projectiles at targets to be awarded points the closer a projectile strikes a particular portion of the target. However, it is difficult, particularly when playing with multiple players, to determine when a player has been struck by a projectile. To identify when a player has been struck with a projectile and where the player was struck by the projectile, various solutions have been brought to market.

One solution was to tip the projectile with a suction cup with the goal of having the projectile stick to the strucked player or a target by the vacuum created within the suction cup. However this requires that the surface being struck by the suction cup tipped projectile be flat and clean from dirt and oils. As players are constantly moving a projectile with the suction cup tip would simply bounce off a player not making it possible to determine if the player was struck. Stationary targets present a better opportunity to work in conjunction with a projectile containing a suction cup but even then the target must have a clean and nonporous flat surface.

An improvement over projectiles containing a suction cup tip are projectiles having a Velcro® covered tip. Here players could wear outer clothing covered with a fabric that would mate with the projectile's velcro covered tip. When a player is struck by a projectile, the velcro allows the projectile to stick to the outer clothing thus verifying that not only was the player struck with a projectile but also the location of where the player was struck. The same means may also be used with a stationary target. Advantages over the suction cup tips of the prior art was that the surface did not have to be flat and nonporous as well as clean to allow a vacuum to be created. However, over time the velcro tips on the projectile would wear out and the projectile would have to be replaced.

U.S. Pat. No. 7,604,556 to John Witzigreuter titled "Chalk marking projectile" used a projectile containing a reservoir containing chalk that was connected to a head that would release a portion of chalk onto the player or target struck with the projectile. Using such a projectile players or targets would be marked when struck. However, some players may not enjoy having their clothes embedded with chalk. In addition, attention must be paid to ensure that the reservoir was filled prior to playing. Finally, it will be difficult to clean the chalk from stationary targets.

Therefore, there is a need for a means that would indicate that a player was struck by a projectile without the need to use a particular type of projectile. The indicating means must be durable, reusable, and low cost.

BRIEF SUMMARY OF THE INVENTION

The indicating means in this disclosure consists of a fabric covered in whole or in part by sequins on its front side the sequins being of one color on its first side and of a second color on its second side. The backside of the fabric is attached to a padding material. The fabric and padding material may be formed into an article of clothing to be worn during play or attached to a structure to form a stationary target. When the fabric is struck by a projectile, the padding layer will absorb the impact by radiating the energy from the impact outward from the point of impact. As the padding vibrates, the sequins will flip from a first position to a second reversed position.

At the start of game play involving multiple players, the players will first brush the sequins on their clothing into a first position that indicates that they have not been struck by a projectile. As play progresses the players struck by a projectile will have sequins that have flipped to their second position. At the end of the game a count is made of the number of spots where the sequins have filled.

At the start of game play involving a target, the players will first brush the sequins on the target into a first position that indicates that the target has not been struck by a projectile. As play progresses and the target is struck by a projectile, the sequins will flip to their second position. At the end of the game, points are awarded to the player by observing where the sequins have flipped.

Sequin covered clothing may also be utilized in various combat related matches such as boxing, martial arts, or fencing to indicate where a player has been struck by an opposing player. At the start of a match both players will "brush" the sequins into a first position to indicate that they have not been struck by the opposing player. As the match progresses and a player is struck, the sequins will flip from the first position to a second position due to vibrations created by the impact of the opponent's hand or weapon. As the location of the impact is recorded by the flipping of the sequins, an appropriate value of points may be awarded to each player.

It is an objective of the present invention to have an indicating means that will function with any type of projectile.

It is yet another objective of the present invention to have an indicating means that does not require an electrical charge to register when struck by a projectile.

It is yet another objective of the present invention to have an indicating means that may be easily reused multiple times.

It is yet another objective of the present invention to have an indicating means that is low cost.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

Neither this summary nor the following detailed description defines or limits the invention. The invention is defined by the claims.

BRIEF DESCRIPTION OF DRAWINGS

The following detailed description of the invention will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

The invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

For the purpose of this disclosure, sequins that are in their first position indicate that the wearer of the clothing or the stationary target has not been struck by a projectile in that region while sequins that are in their second position indicate that the wearer of the clothing or the stationary target has been struck by a projectile in that region. Also for the purpose of this disclosure the diameter of the sequins in the figures have been exaggerated so as to show detail. Additionally, reference number 14 and 16 both reference one or more sequins. In particular, reference number 14 indicates one or more sequins in its first position while reference number 16 indicates one or more sequins in its second position.

Figure 1:
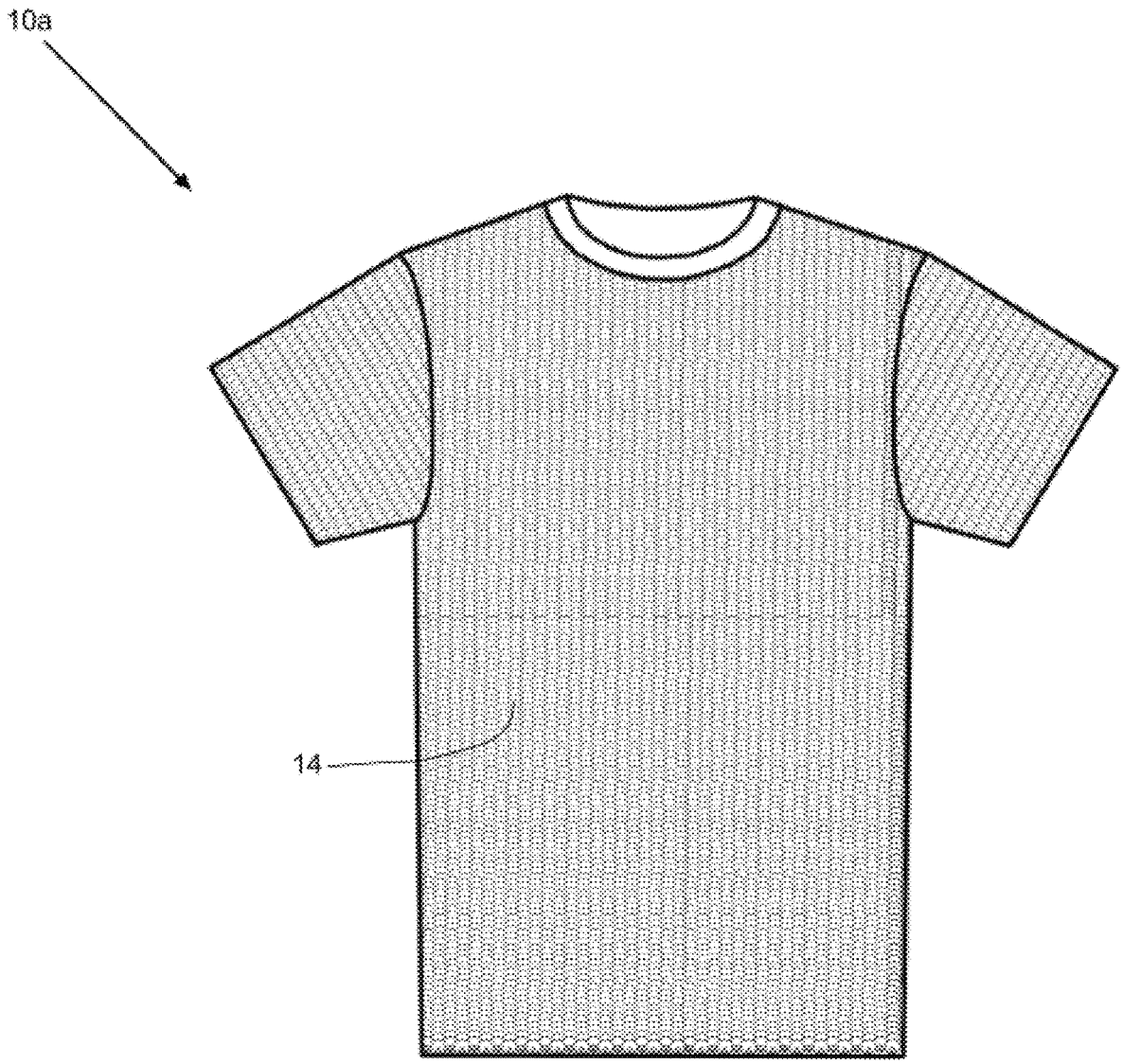
FIG. 1 shows an article of clothing having on its surface reversible sequins in a first position in accordance with the present invention.

FIG. 1 shows preferred embodiment shirt 10*a* covered with sequins 14, minus the collar, in their first position indicating that the wearer has not been struck by a projectile. Although sequins 14 are shown arranged vertically so that they flip from one position to another in an up and down fashion, the sequins may also be arranged horizontally so that they flip from one position to another in a side to side fashion. Shirt 10*a* may be a shirt, vest, or any other type of wearable that may be worn by a player.

Figure 2:
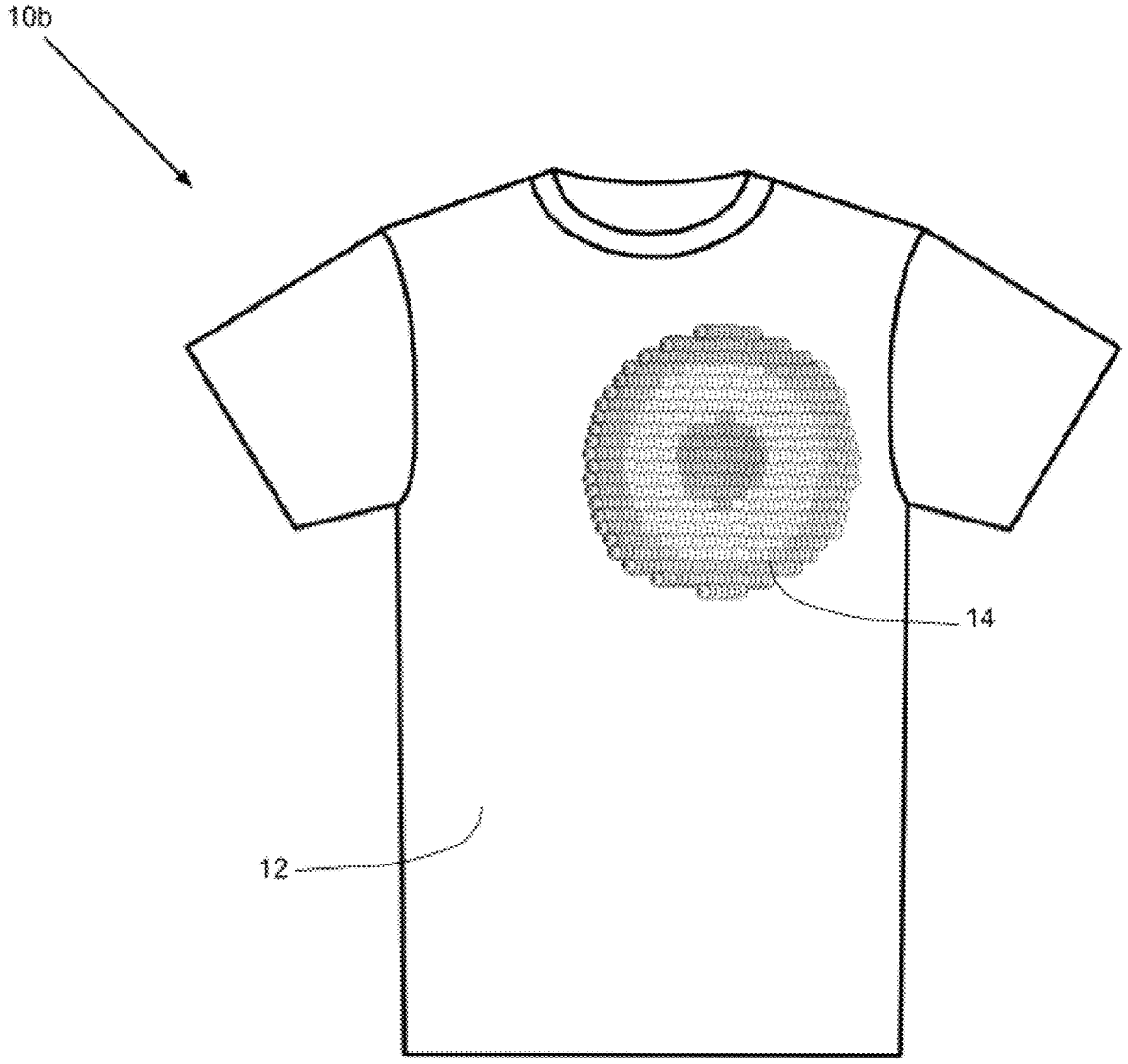
FIG. 2 shows an article of clothing having on a portion of its surface reversible sequins in a first position where the sequins in the first position are of different colors to indicate a point level.

FIG. 2 shows an alternate embodiment shirt 10*b* partially covered with sequins 14 in their first position while the remaining portion 12 of shirt 10*b* is not covered with sequins. In addition, sequins 14 in their first position display a pattern to indicate varying point values. In FIG. 2 the pattern is of a traditional target with concentric circles. The innermost circle indicates the highest point value while portion 12 would indicate no point value given to the shooter of a projectile that struck the wearer of shirt 10*b*. Sequins 14 may be arranged in different patterns and in multiple locations on shirt 10*b* and may display any number of indicators for awarding a point value. Shirt 10*b* shows sequins arranged in a horizontal fashion so that sequins 14 flip from one position to another in a side to side fashion. Shirt 10*b* may be a shirt, vest, or any other type of wearable that may be worn by a player.

Figure 3:
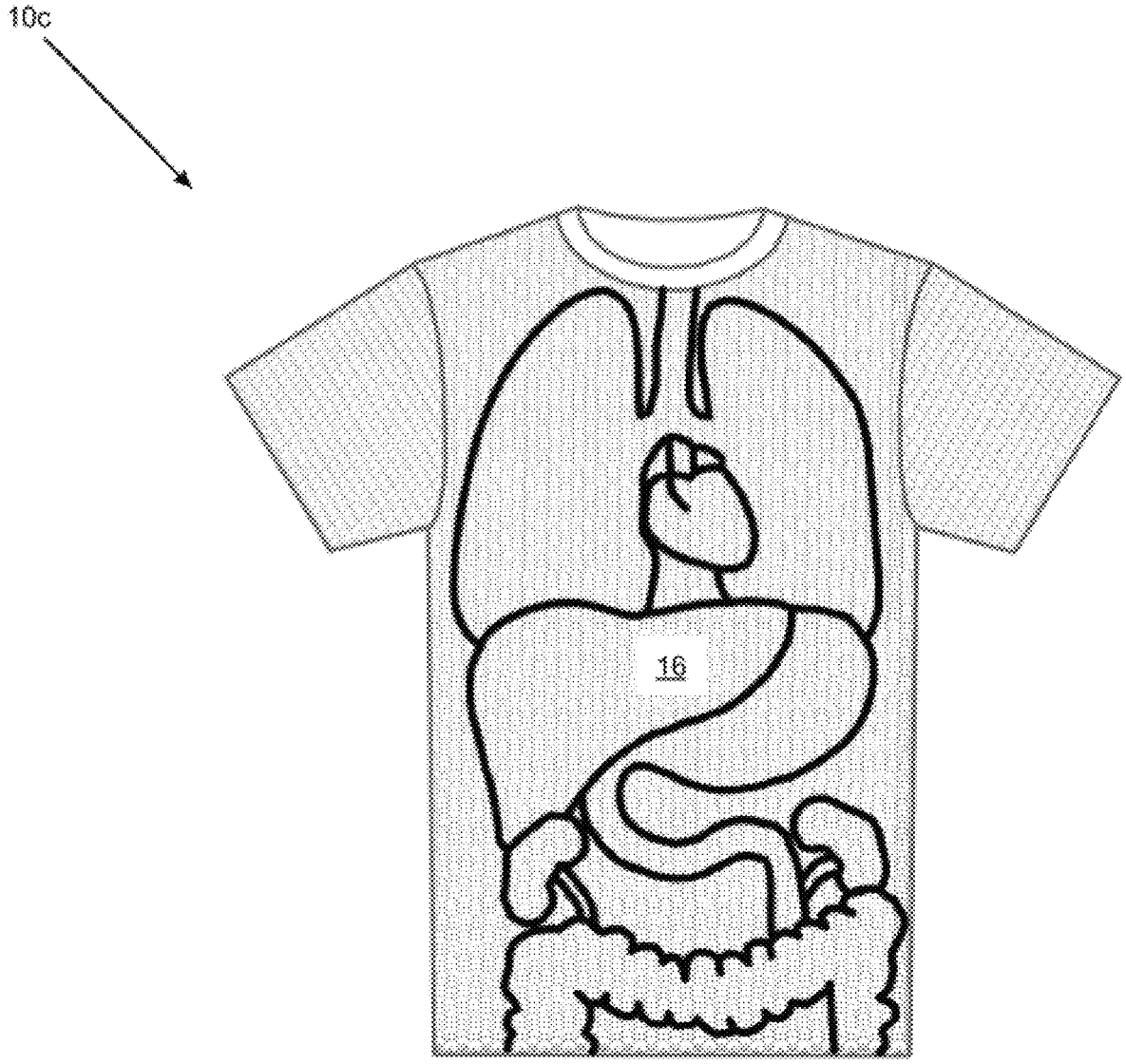
FIG. 3 shows an article of clothing having on its surface reversible sequins in a second position where the sequins in the second position displays an image.

FIG. 3 shows an alternate embodiment shirt 10*c* covered with sequins 16, minus the collar, in their second position, that is the position the sequins flip to when being struck by a projectile. As is shown in FIG. 3 is that the sequins in their second position displays an image and, in the case of FIG. 3, the image being of the human organs found within the torso. The image may also be targets of varying values or size and shapes. When being struck by a projectile the sequins flip to their second position to display the significance of the projectile contact. Shirt 10*c* may be a shirt, vest, or any other type of wearable that may be worn by a player.

Figure 4:
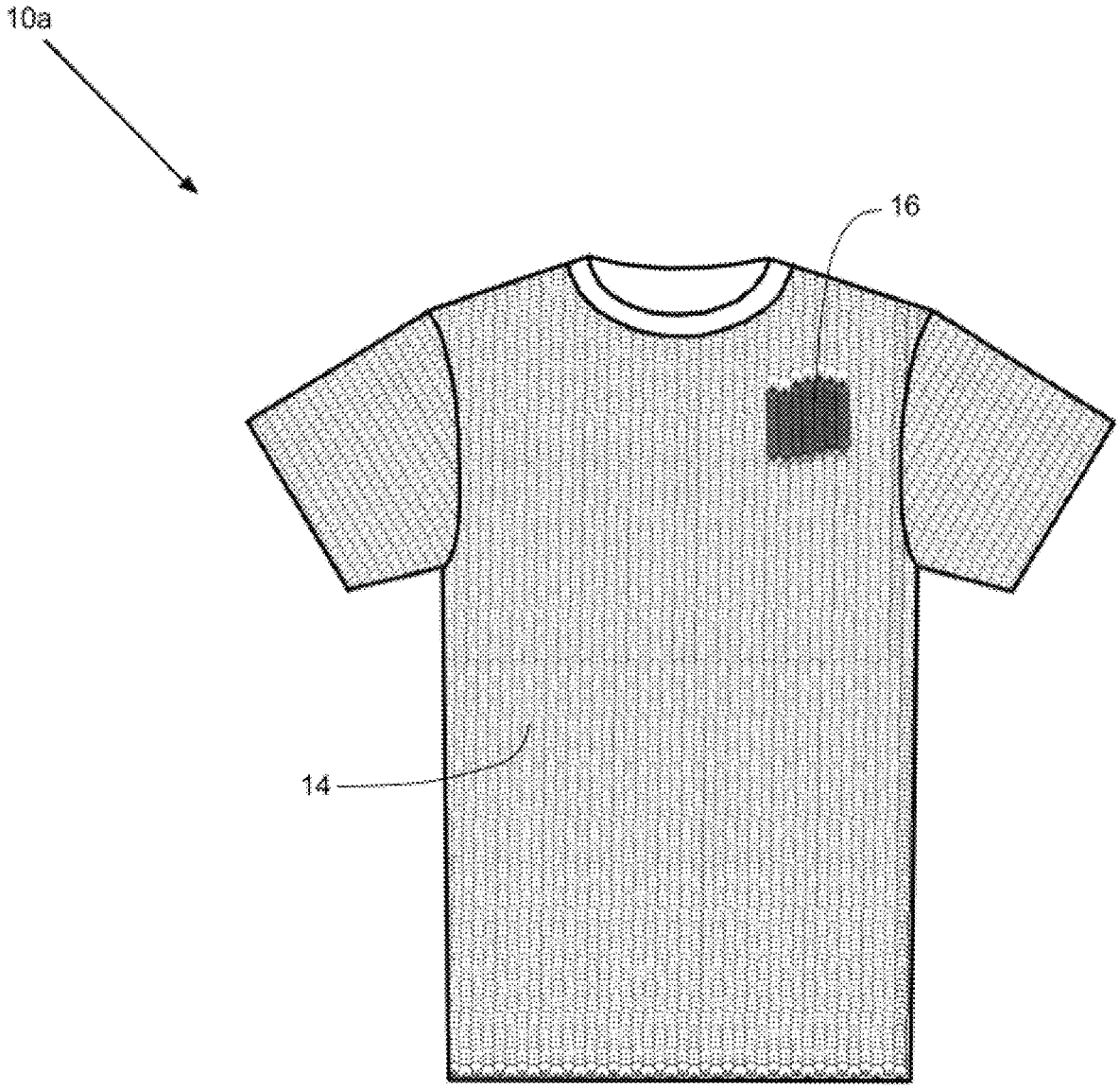
FIG. 4 shows an article of clothing having on its surface reversible sequins generally in a first position and of a first color and a subset in a second position and of a second color to indicate that the wearer of the clothing has been struck by a projectile.

FIG. 4 shows shirt 10*a* with a portion of sequins in their second position as indicated by 16. The transition of the sequins from their first position to their second position is caused by the force of a projectile impacting the sequins. When a projectile impacts the wearer of shirt 10, the kinetic energy of the impact is absorbed by a layer of padding that is not shown and under shirt 10. The padding releases the absorbed energy by undulations radiating outwardly from the point of impact much like the waves that are created in a pool of water when a rock is dropped into the pool. The undulations will cause some of the sequins experiencing the undulations to change from their first position to their second position. The transition from the first to the second position does not radiate uniformly from the point of impact due to the orientation of how the sequins are hinged to the shirt and the contours of the human body but a sufficient number of sequins do transition from the first to the second position to clearly indicate that the wearer of shirt 10 or a target has been struck by a projectile.

Figure 5A:
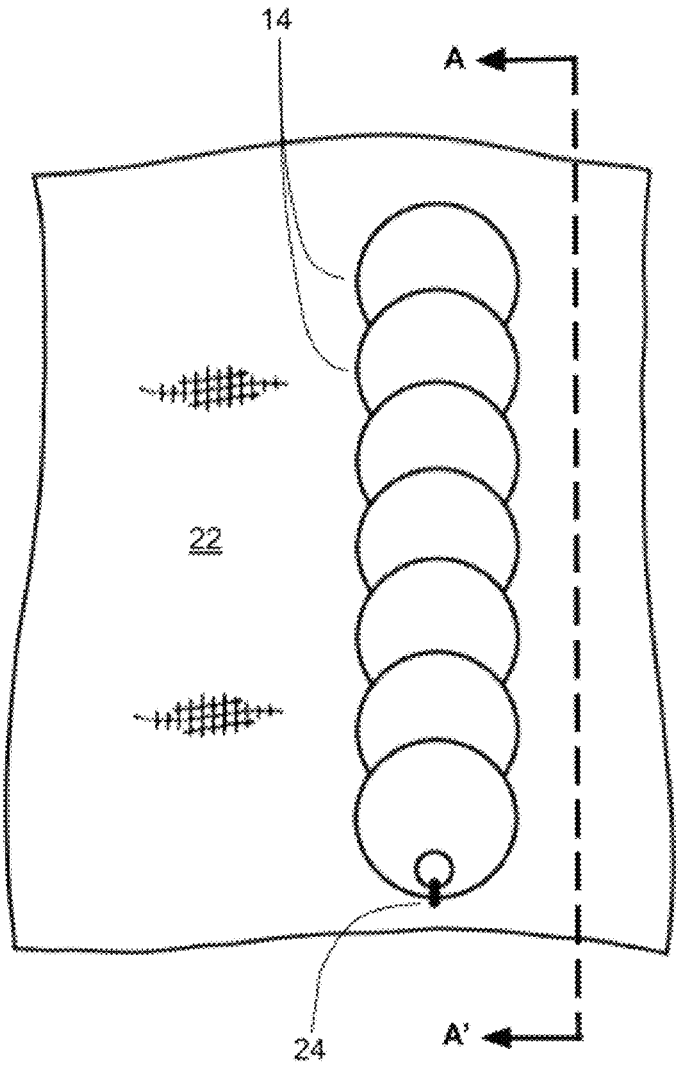
FIG. 5A shows an enlarged view of a portion of the article of clothing in FIG. 1 with the reversible sequins in their first position.
Figure 5B:
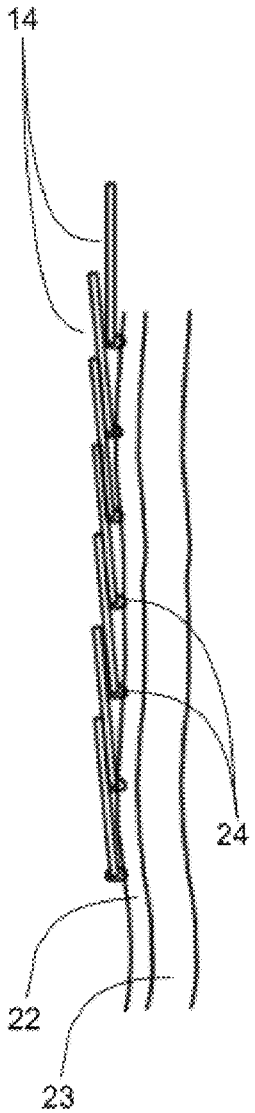
FIG. 5B is a sectional view of the sequins in a first position taken along line A-A' of FIG. 5A.

FIGS. 5A and 5B shows a detail view of sequins 14 arranged in their first position on fabric 22. FIG. 5A shows an enlarged perspective top view of the sequins in their first position while FIG. 5B shows a section view taken along line A-A' of FIG. 5A. Each sequin 14 is attached to fabric 22 at hinge 24. In FIG. 5A each sequin 14 displays an identical color but could, as a group, display an alternate color as shown by shirt 10*b* in FIG. 2 or an image as shown by shirt 10*c* in FIG. 3. At the start of play, the wearer will "brush" the sequins into their first position to indicate that they have not been struck by a projectile. Fabric 22 is attached to padding 23. Padding 23 is essential in causing one or more sequins to change from its first position to its second position. Padding 23 absorbs energy created by the impact of the projectile and directs the energy outward from the point of impact. As the energy radiates outwardly, padding 23 will undulate causing the sequins on fabric 22 to change position.

Figure 6A:
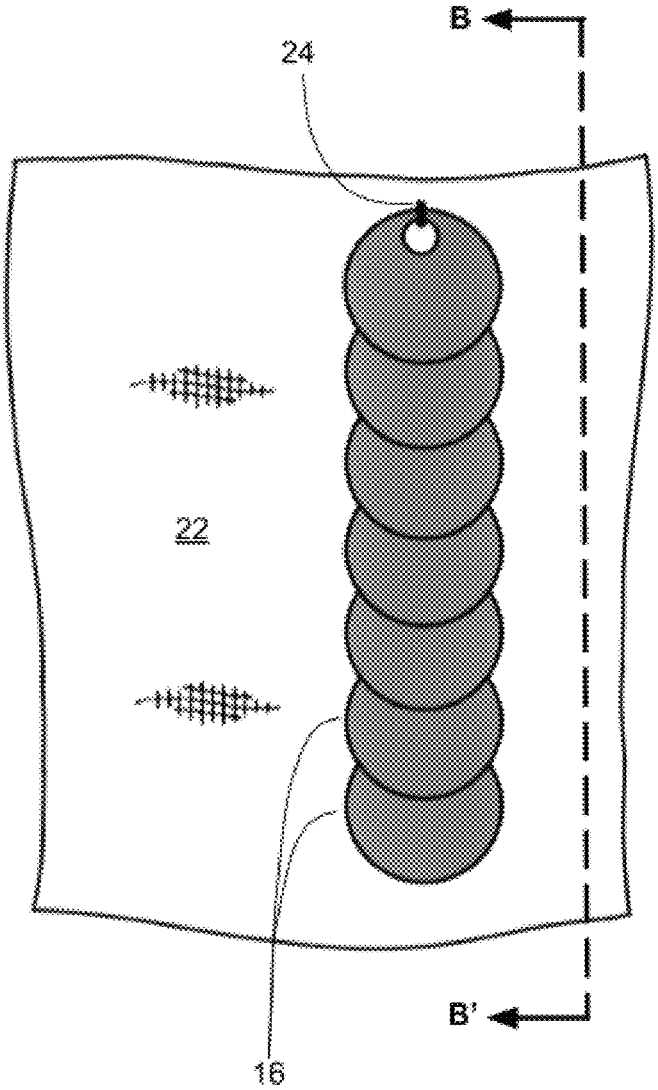
FIG. 6A shows an enlarged view of a portion of the article of clothing in FIG. 1 with the reversible sequins in their second position.
Figure 6B:
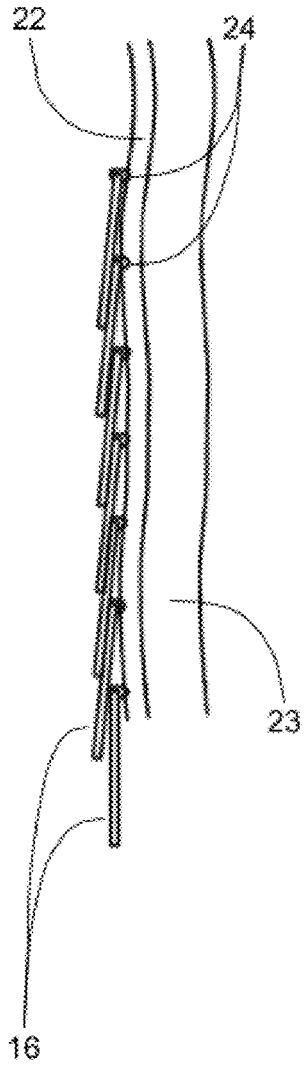
FIG. 6B is a sectional view of the sequins in a second position taken along line B-B' of FIG. 6A.

FIGS. 6A and 6B show a detail view of sequins 16 arranged in their second position on fabric 22. FIG. 6A shows an enlarged perspective top view of the sequins in their second position while FIG. 6B shows a section view taken along line B-B' of FIG. 6A. Each sequin 16 is attached to fabric 22 at hinge 24. During play, if the wearer is struck by a projectile, the kinetic energy of the projectile will be transferred onto fabric 22 and onto padding 23. Padding 23 is essential in causing one or more sequins to change from its first position to its second position. Padding 23 absorbs energy created by the impact of the projectile and directs the energy outward from the point of impact. As the energy radiates outwardly, padding 23 will undulate causing the sequins on fabric 22 to change position.

Figure 7A:
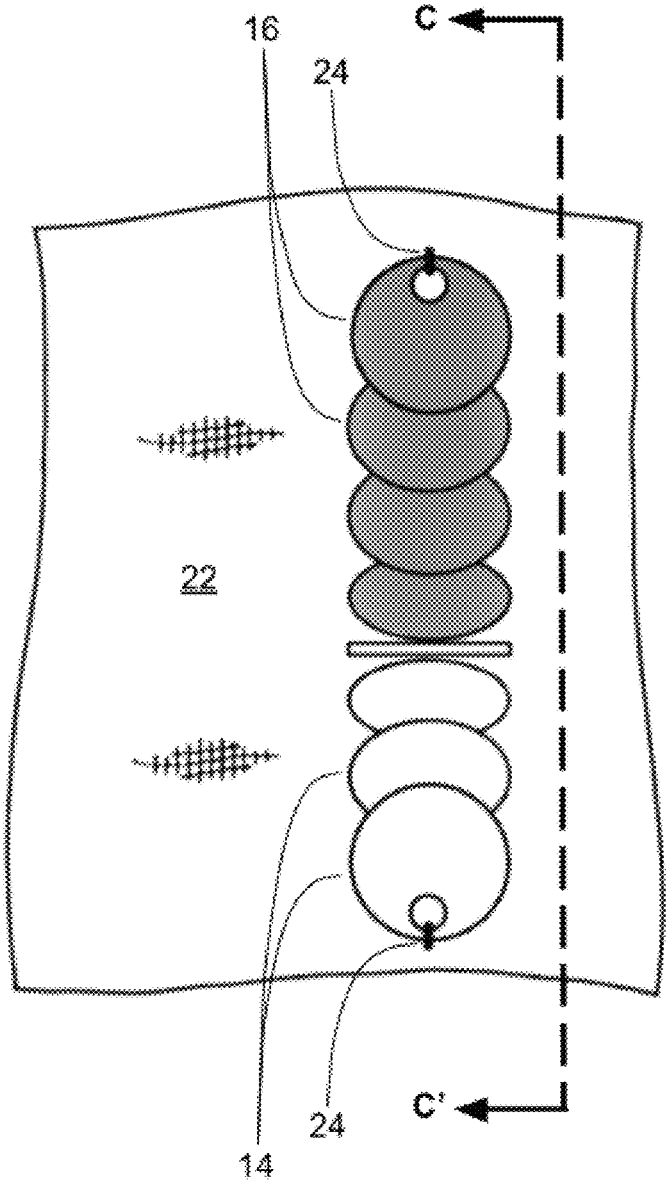
FIG. 7A shows an enlarged view of a portion of the article of clothing in FIG. 1 where sequins are in transition between positions.
Figure 7B:
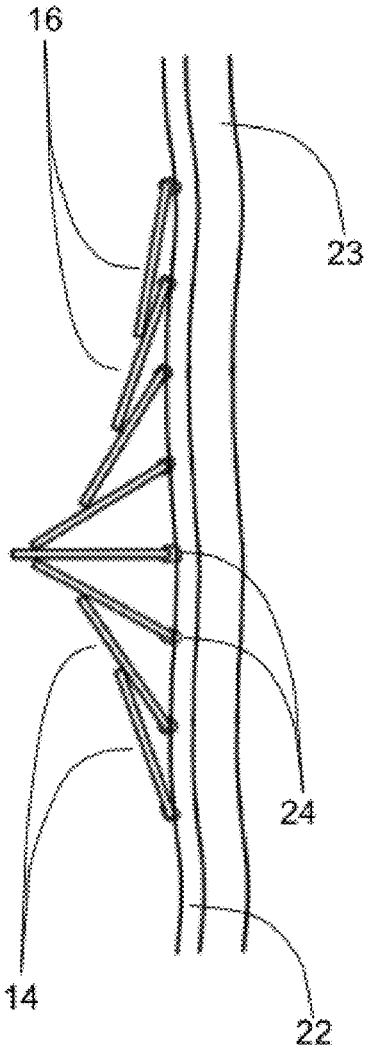
FIG. 7B is a sectional view of the sequins transitioning between positions taken along line C-C' of FIG. 7A.

FIGS. 7A and 7B show a detail view of sequins 14 and 16 as they are transitioning from one position to another on fabric 22. FIG. 7A shows an enlarged perspective top view of the sequins transitioning from one position to another while FIG. 7B shows a section view taken along line C-C' of FIG. 7A. Each sequin 14 or 16 is attached to fabric 22 at hinge 24.

Figure 8:
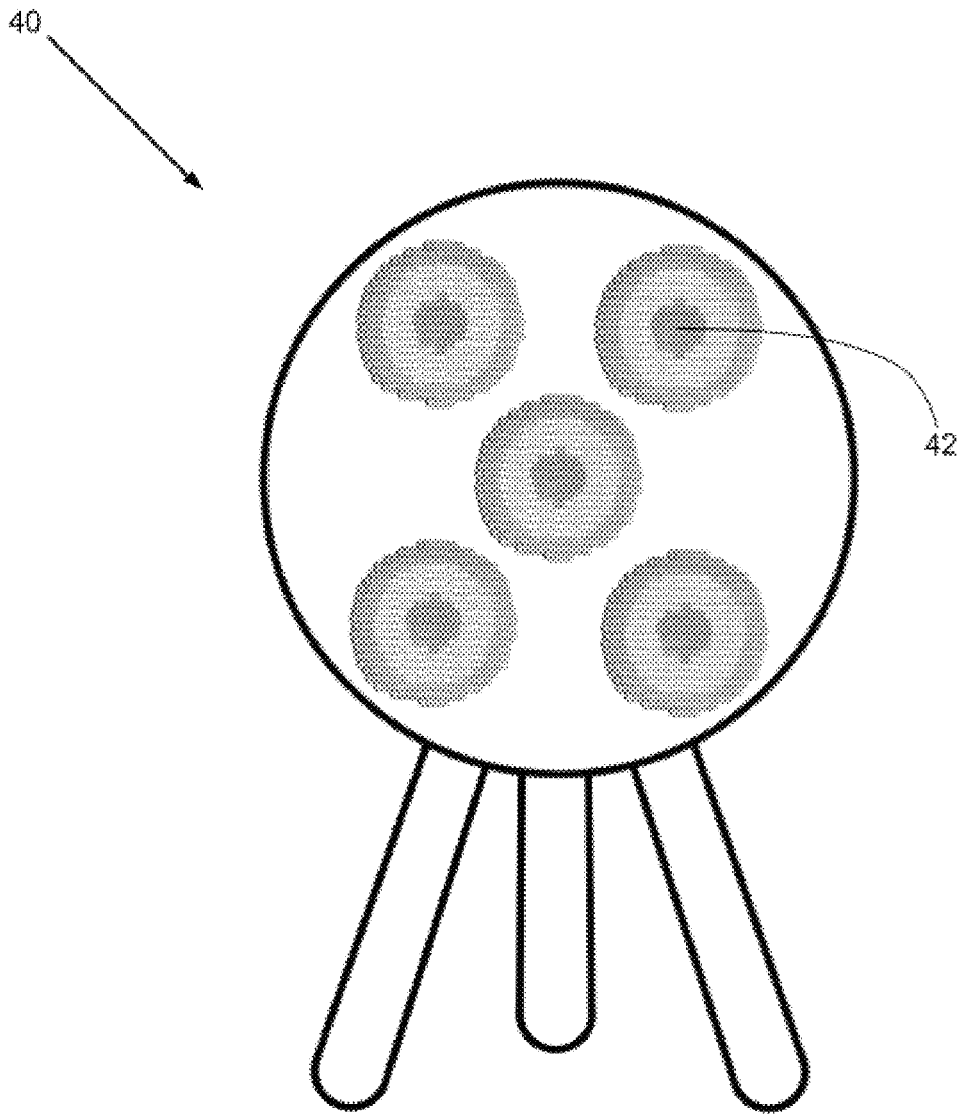
FIG. 8 shows a stationary disk having on its surface reversible sequins in a first position in accordance with the present invention displaying one or more targets.

FIG. 8 shows another usage of the sequins of this disclosure wherein the sequins are used to cover target 40. Target 40 may be partially covered by sequins arranged as smaller subtargets 42 as shown here in FIG. 8 or the entire target 40 may be covered by sequins. The sequins of each subtarget 42 is "brushed" into the first position at the start of competition. As the sequins found on target 40 are struck by a projectile, they will change from the first position to their second position upon impact by the projectile as discussed in FIGS. 5, 6, and 7. When the sequins of subtargets 42 are in their first position they display a pattern of concentric circles but may display any pattern that is appropriate for the competition. Furthermore, the layout and number of subtargets 42 may be changed as is appropriate for the competition. In addition to the layer of fabric 22 and padding 23, target 40 will further have a structure behind padding 23 to support fabric 22 and padding 23.

Figure 9:
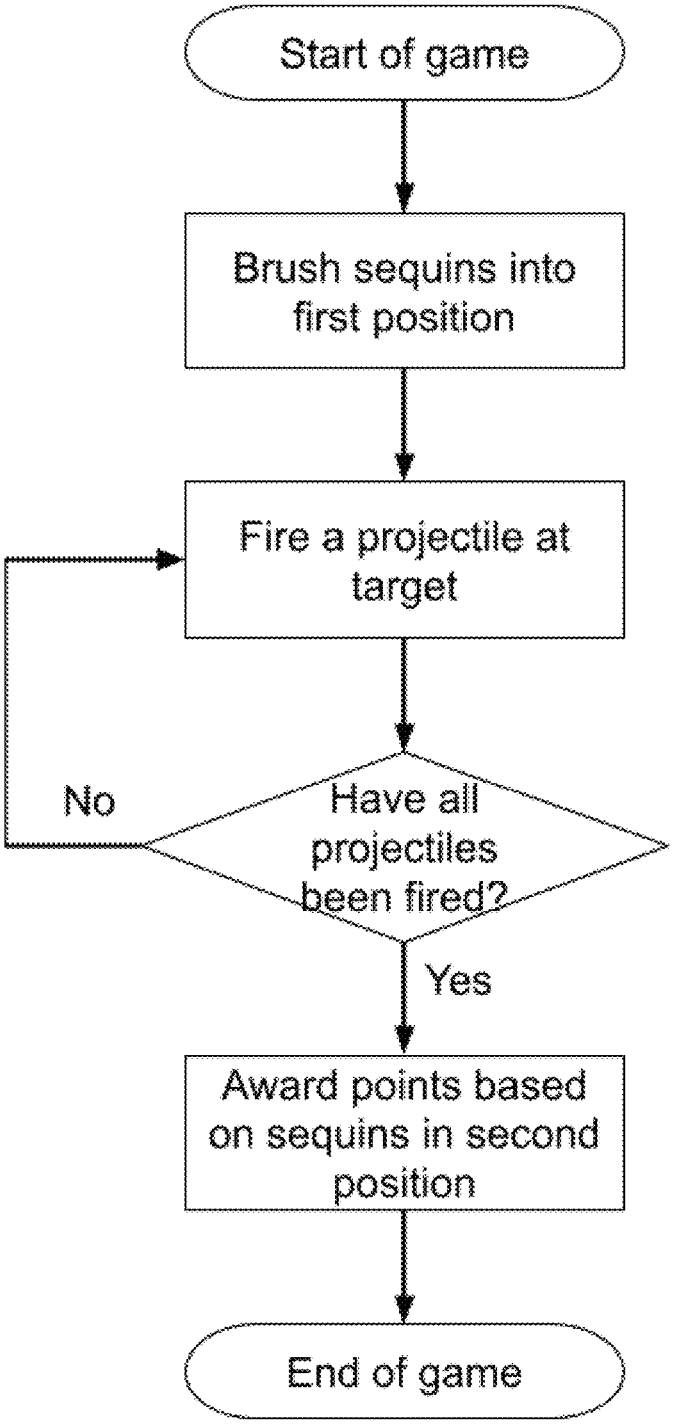
FIG. 9 shows a flowchart that describes a method for using the stationary disk of FIG. 8.

When utilizing target 40, play will be conducted as shown in FIG. 9. At the start of the game the player will first brush sequins into their first position to indicate that the target has not been struck by a projectile. Then the play will fire a projectile at the target and will continue to fire projectiles until all of the projectiles are expended. At that point the player or a referee will approach the target and award points to the player depending upon the sequins that are in their second position.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

What is claimed is:

1. An article of clothing constructed with an indicating means to indicate when the wearer of the article of clothing has been impacted by an object during game play or sporting event, the construction of the article of clothing comprising:
- a plurality of sequins arranged in the fashion of a matrix having
  - a first surface,
  - a second surface opposite the first surface, and
  - an aperture proximate to its periphery and extending between the first and second surfaces;
- a layer of fabric;
- one or more threads to secure the sequins to the fabric by way of the aperture so that the sequin may flip between its first and second surface; and
- a layer of padding secured to the layer of fabric on the side opposite the sequins;
- so that when the fabric is impacted by an object during game play the padding will undulate and cause the sequins to flip between its surfaces about the point of impact.

2. The indicating means of claim 1 wherein the article of clothing is a vest, tank top, short sleeve t-shirt, or long sleeve t-shirt.

3. The indicating means of claim 1 wherein the first surface and the second surface are of contrasting colors.

4. The indicating means of claim 1 wherein the object is a projectile.

5. The indicating means of claim 1 wherein the object is an opponent's body part.

6. The indicating means of claim 1 wherein an image is formed by a combination of sequins when displaying their first surface.

7. The indicating means of claim 1 wherein an image is formed by a combination of sequins when displaying their second surface.

8. A target constructed with an indicating means to indicate when the target has been impacted by a projectile during game play or sporting event, the construction of the target comprising:
- a plurality of sequins arranged in the fashion of a matrix having
  - a first surface,
  - a second surface opposite the first surface, and
  - an aperture proximate to its periphery and extending between the first and second surfaces;
- a layer of fabric;
- one or more threads to secure the sequins to the fabric by way of the aperture so that the sequin may flip between its first and second surface;
- a layer of padding secured to the layer of fabric on the side opposite the sequins; and
- a layer of a durable material secured to the layer of padding opposite the fabric to form the target;
- so that when the fabric is impacted by a projectile during game play the padding will undulate and cause the sequins to flip between its surfaces about the point of impact.

* * * * *